US008522562B2

(12) United States Patent
Ludtka et al.

(10) Patent No.: US 8,522,562 B2
(45) Date of Patent: Sep. 3, 2013

(54) APPARATUS AND METHOD FOR MAGNETICALLY PROCESSING A SPECIMEN

(75) Inventors: Gerard M. Ludtka, Oak Ridge, TN (US); Gail M. Ludtka, Oak Ridge, TN (US); John B. Wilgen, Oak Ridge, TN (US); Roger A. Kisner, Knoxville, TN (US); Roger A. Jaramillo, Milton, WV (US)

(73) Assignee: UT-Battelle, LLC, Oak Ridge, TN (US)

( * ) Notice: Subject to any disclaimer, the term of this patent is extended or adjusted under 35 U.S.C. 154(b) by 105 days.

(21) Appl. No.: 13/198,180

(22) Filed: Aug. 4, 2011

(65) Prior Publication Data

US 2012/0324908 A1 Dec. 27, 2012

Related U.S. Application Data

(60) Provisional application No. 61/501,576, filed on Jun. 27, 2011.

(51) Int. Cl.
*F25B 21/00* (2006.01)

(52) U.S. Cl.
USPC ..... 62/3.1; 62/3.7; 62/118; 62/914

(58) Field of Classification Search
USPC ..... 62/3.1, 3.2, 3.3, 3.7, 118, 190, 467, 62/914; 361/147, 259; 165/65, 185
See application file for complete search history.

(56) References Cited

U.S. PATENT DOCUMENTS 3,125,861 A * 3/1964 Jaep ..... 62/3.7
3,819,299 A 6/1974 Brown ..... 417/52
3,841,107 A 10/1974 Clark ..... 62/3
4,520,249 A * 5/1985 Czerlinski ..... 219/634
4,727,721 A 3/1988 Peschka et al. ..... 62/3
4,956,976 A 9/1990 Kral et al. ..... 62/51.3
5,091,361 A 2/1992 Hed ..... 505/1
5,182,914 A 2/1993 Barclay et al. ..... 62/3.1
5,249,424 A 10/1993 DeGregoria et al. ..... 62/3.1
5,376,184 A * 12/1994 Aspden ..... 136/203
5,381,664 A 1/1995 Bennett et al. ..... 62/3.1
5,641,424 A * 6/1997 Ziolo et al. ..... 252/67
5,934,078 A 8/1999 Lawton, Jr. et al. ..... 62/3.1
6,446,441 B1 9/2002 Dean ..... 62/3.1
6,526,759 B2 3/2003 Zimm et al. ..... 62/3.1
6,668,560 B2 12/2003 Zimm et al. ..... 62/3.1

(Continued)

OTHER PUBLICATIONS

"*Magnetic Refrigeration*" Wikipedia, the free encyclopedia (2006).

(Continued)

*Primary Examiner* — Mohammad M Ali
(74) *Attorney, Agent, or Firm* — Brinks Hofer Gilson & Lione

(57) ABSTRACT

An apparatus for magnetically processing a specimen that couples high field strength magnetic fields with the magnetocaloric effect includes a high field strength magnet capable of generating a magnetic field of at least 1 Tesla and a magnetocaloric insert disposed within a bore of the high field strength magnet. A method for magnetically processing a specimen includes positioning a specimen adjacent to a magnetocaloric insert within a bore of a magnet and applying a high field strength magnetic field of at least 1 Tesla to the specimen and to the magnetocaloric insert. The temperature of the specimen changes during the application of the high field strength magnetic field due to the magnetocaloric effect.

18 Claims, 3 Drawing Sheets

(56) References Cited

U.S. PATENT DOCUMENTS

| | | | | |
|---|---|---|---|---|
| 6,676,772 | B2 * | 1/2004 | Saito et al. | 148/301 |
| 6,758,046 | B1 | 7/2004 | Barclay et al. | 62/3.1 |
| 7,063,754 | B2 * | 6/2006 | Fukamichi et al. | 148/301 |
| 7,076,958 | B2 * | 7/2006 | Saito et al. | 62/3.1 |
| 7,076,959 | B2 * | 7/2006 | Lewis | 62/3.1 |
| 7,745,765 | B2 | 6/2010 | Kisner et al. | 219/635 |
| 2002/0053209 | A1 | 5/2002 | Zimm et al. | 62/3.1 |
| 2003/0051774 | A1 * | 3/2003 | Saito et al. | 148/302 |
| 2003/0106323 | A1 | 6/2003 | Zimm et al. | 62/3.1 |
| 2004/0182086 | A1 | 9/2004 | Chiang et al. | 62/3.1 |
| 2004/0261420 | A1 * | 12/2004 | Lewis | 62/3.1 |
| 2005/0000230 | A1 * | 1/2005 | Saito et al. | 62/3.1 |
| 2005/0172643 | A1 | 8/2005 | Lewis | 62/3.1 |
| 2006/0218936 | A1 | 10/2006 | Kobayashi et al. | 62/3.1 |
| 2006/0278373 | A1 | 12/2006 | Hsu | 165/104.33 |
| 2006/0292013 | A1 | 12/2006 | Love et al. | 417/207 |
| 2007/0130960 | A1 | 6/2007 | Muller et al. | 62/3.1 |
| 2008/0303375 | A1 | 12/2008 | Carver | 310/306 |
| 2009/0025398 | A1 | 1/2009 | Muller et al. | 62/3.1 |
| 2009/0217674 | A1 * | 9/2009 | Kaji et al. | 62/3.1 |
| 2010/0107654 | A1 * | 5/2010 | Rowe et al. | 62/3.1 |
| 2010/0212327 | A1 | 8/2010 | Barve et al. | 62/3.1 |

OTHER PUBLICATIONS

Gschneidner K.A. et al., "*Magnetocaloric Materials*" Annu. Rev. Mater. Sci., 30 (2000) pp. 387-429.

Ludtka G. M. et al., "*First Principles Modeling, Fabrication, and Characterization of the Next Generation of Advanced Magnetocaloric Materials for Energy Efficiency Applications*" National High Magnetic Field Laboratory 2010 Research Report, pp. 1.

* cited by examiner

APPARATUS AND METHOD FOR MAGNETICALLY PROCESSING A SPECIMEN

RELATED APPLICATION

The present patent document claims the benefit of the filing date under 35 U.S.C. 119(e) of U.S. Provisional Patent Application Ser. No. 61/501,576, filed Jun. 27, 2011, and hereby incorporated by reference in its entirety.

FEDERALLY SPONSORED RESEARCH OR DEVELOPMENT

The invention described in this disclosure was made with government support under Prime Contract Number DE-AC05-000R22725 awarded by the Department of Energy. The government has certain rights in this invention.

TECHNICAL FIELD

The present disclosure relates generally to the magnetic processing of materials and more specifically to a method of material processing that couples a high field strength magnetic field with the magnetocaloric effect.

BACKGROUND

The magnetocaloric effect (MCE) refers to an effect in which a magnetic field causes either warming or cooling in a magnetic sample when the magnetic field is applied in the vicinity of the material's Curie temperature. A change in temperature results from a change in the magnetic entropy of the system (e.g., alignment of spins) when the field is applied. Due to this effect, it may be possible to develop a magnetization versus temperature cycle that results in magnetic cooling (e.g., a magnetic refrigerator) or heating (e.g., a magnetic heater). The magnetic cooling cycle may be referred to as a magnetic Stirling cycle. For example, Ames Laboratory and Astronautics Corp. of America have built a demonstration magnetic refrigerator using Gd spheres (~150-300 microns in diameter) with a 5-Tesla magnet and yielded 600 W cooling power producing a $\Delta T=38K$ with up to 60% Carnot efficiency. The unit operated with a cycle of 0.17 Hz.

BRIEF SUMMARY

An apparatus and a method for magnetically processing a specimen that couple high strength magnetic fields with the magnetocaloric effect are described.

The apparatus comprises a high field strength magnet capable of generating a magnetic field of at least 1 Tesla, and a magnetocaloric insert disposed within a bore of the high field strength magnet.

The method includes positioning a specimen adjacent to a magnetocaloric insert within a bore of a magnet and applying a high field strength magnetic field of at least 1 Tesla to the specimen and to the magnetocaloric insert. The temperature of the specimen changes during the application of the high field strength magnetic field due to the magnetocaloric effect.

The method also may include the insertion/withdrawal of a specimen with a Curie temperature into the bore of a magnet with the sample at or near its Curie temperature and not requiring a separate magnetocaloric effect insert to induce a temperature change in the specimen.

DETAILED DESCRIPTION

Figure 1:
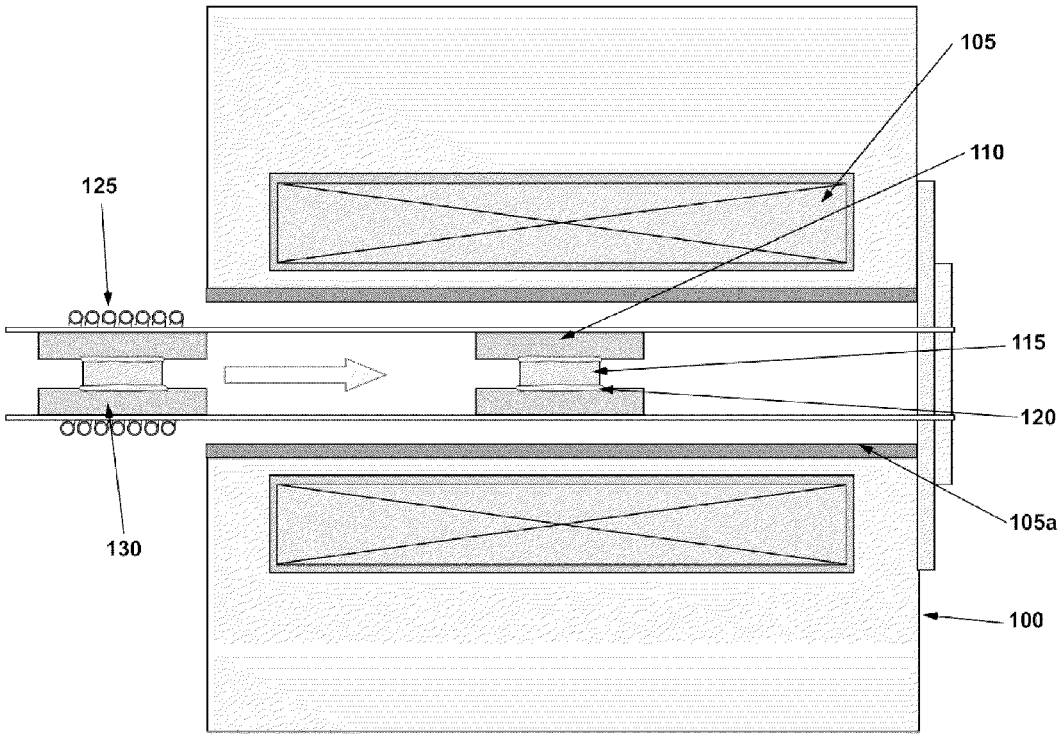
FIG. 1 is a schematic of an exemplary apparatus including a magnetocaloric insert within the bore of a high field strength magnet.
Figure 2:
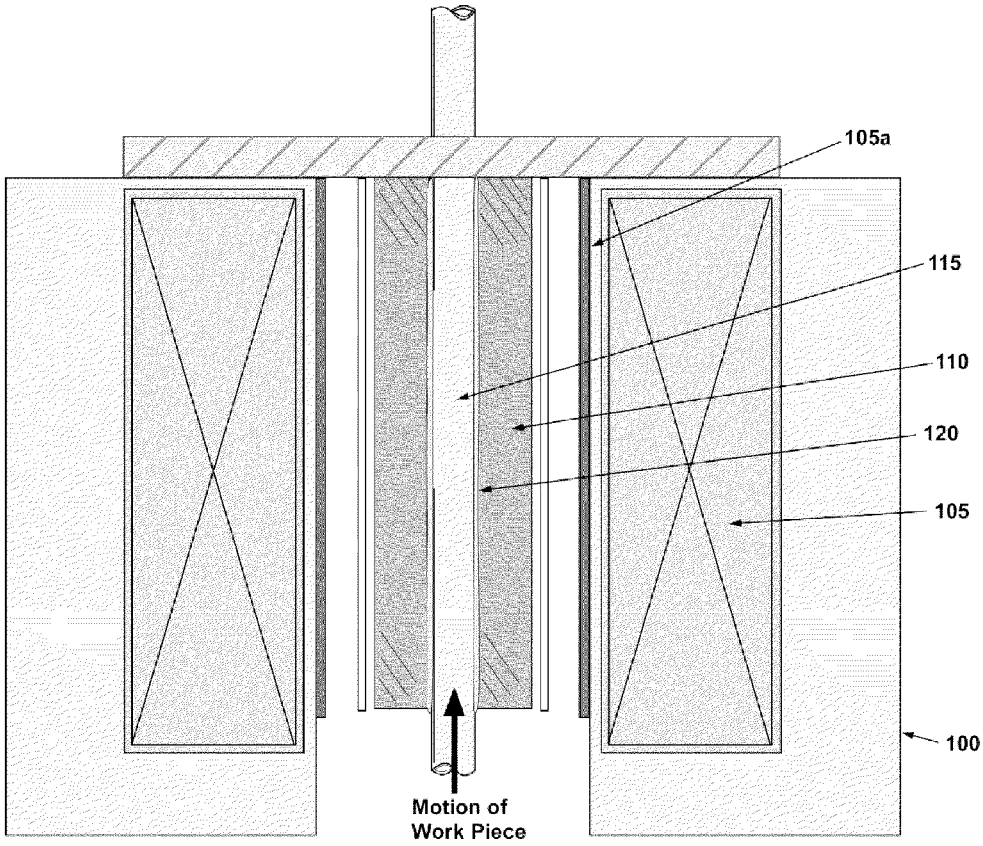
FIG. 2 is a schematic of an exemplary apparatus including a magnetocaloric insert within the bore of a high field strength magnet.

FIGS. 1 and 2 show two embodiments of an exemplary apparatus for magnetically processing a specimen, where a high field strength magnetic field is coupled with the magnetocaloric effect. The apparatus 100 includes a high field strength magnet 105 capable of generating a magnetic field of at least 1 Tesla, and a magnetocaloric insert 110 disposed within a bore 105*a* of the high field strength magnet 105. The magnetocaloric insert 110 comprises a material that exhibits a measurable magnetocaloric effect (MCE) in response to the magnetic field. Accordingly, the insert is capable of changing in temperature when the field is applied.

When the magnetocaloric insert 110 and a specimen 115 positioned within the bore 105*a* of the magnet 105 are exposed to a high field strength magnetic field produced by the magnet 105, the specimen may be influenced simultaneously by the thermodynamic effect of the applied field and by the change in temperature of the magnetocaloric insert 110. The technology may be applied to thermomagnetically process non-ferromagnetic alloys that exhibit eutectoid or monotectoid transformations for the purpose of grain refinement, for example, by repeatedly thermally cycling about the eutectoid (or monotectoid) transformation temperature.

In one example, the method may be applied to a beryllium-copper (Be—Cu) alloy to increase strength through grain refinement. Such alloys are used to make non-sparking tools for use in environments with severe explosion hazards or near high magnetic field systems. Referring again to FIG. 1, the sample-insert assembly 130 (which includes the beryllium-copper alloy specimen 115 surrounded by the magnetocaloric insert 110) is heated outside the magnet in an induction heater 125 in the two-phase field and held just below the eutectoid reaction transformation temperature isotherm. The sample-insert assembly 130 is then inserted into the bore of the magnet. The eutectoid transformation temperature of the non-ferromagnetic material is not shifted significantly by the magnetic field (even at very high field strengths, in contrast to the behavior of a ferromagnetic material) but the temperature of the insert 110 rises, causing the sample temperature to go over the eutectoid transformation temperature and convert to a single phase material. Both are now removed from the bore 115*a* of the magnet 115 and the temperature of the sample 115 and insert 110 drop, which causes a return to the two-phase microstructure via the eutectoid transformation, resulting in finer grain size with this cycle. Repeating this cycle will continue to refine grain size, which results in simultaneous increases in yield strength and ductility. Also, if the insert's mass is small relative to the mass of the sample, only the surface layer of the sample will be impacted by the temperature rise and undergo phase transformation locally. This can result in a finer grain size in the surface region giving improved fatigue performance with the resultant gradient microstructure (variable grain size from finer on the surface to coarser in the interior). The magnitude of the temperature shift can be tailored by appropriate selection of the magnetocaloric insert base material and the magnitude (strength) of the magnetic field.

As shown in FIGS. 1 and 2, the magnetocaloric insert 110 may have a hollow shape configured to radially surround the specimen 115 positioned within the bore 105*a* of the magnet 105. The magnetocaloric insert 110 may be configured to be in physical contact with the specimen 115; alternatively, there may be a space between part or all of the insert 110 and the specimen 115, as shown in the figures.

The space may accommodate a thermally conductive material 120 provided to enhance heat transfer to or from the specimen. For example, the thermally conductive material 120 may be positioned radially inward from the magnetocaloric insert 110. In the embodiments of FIGS. 1 and 2, the thermally conductive material 120 takes the form of an conductive sleeve or coil, although other configurations are possible. The thermally conductive material 120 may be in physical contact with one or both of the specimen 115 and the insert 110. In another embodiment, the thermally conductive material 120 may be positioned at one or both ends of the specimen 115 adjacent to the insert 110. This configuration may be particularly advantageous when the magnetocaloric insert 110 radially surrounds the specimen 115 and is also in physical contact with the specimen 115.

The MCE is intrinsic to magnetic materials and may be maximized when the magnetic material is near its magnetic ordering temperature, which is called the Curie temperature. When an adiabatic magnetic field is applied to a ferromagnetic material, the magnetic entropy of the material is reduced, which in turn leads to an increase in lattice entropy to maintain the entropy at a constant value (required for a closed system), and thus the material is heated. In a reversible process, upon adiabatic removal of the applied magnetic field, the magnetic entropy of the ferromagnetic material increases and the lattice entropy decreases, and thus the material is cooled. Magnetic materials exhibiting large MCEs, where the MCE may be defined as the change in isothermal magnetic entropy when exposed to a magnetic field, have been identified. For example, a measurable MCE has been obtained in a light lanthanide metal, polycrystalline Nd, and the heavy magnetic lanthanides, both polycrystalline and single crystalline Gd, Tb, and Dy, and polycrystalline Ho, Er, and Tm. Transition metals such as Fe, Co and Ni also exhibit MCEs at their respective Curie points. (K. A. Gschneider, Jr. and V. K. Pecharsky, "Magnetocaloric Materials," *Annu. Rev. Mater. Sci.* 2000, 30:387-429)

The magnetocaloric insert 110 may therefore include a metal selected from the group consisting of Ce, Co, Cu, Dy, Er, Fe, Ga, Gd, Ho, La, Mn, Nd, Ni, Tb, and Tm. These metals and their alloys, in particular Gd and its alloys, are known to exhibit large MCEs. A giant magnetocaloric effect (GMCE) may be attained when the insert is formed of a magnetic alloy having its Curie temperature (second order phase change temperature) near a temperature at which a first order phase change occurs. In other words, a larger MCE temperature rise may be obtained from a magnetic material that has a Curie temperature coupled with a first order phase change temperature.

The magnetocaloric insert 110 may take the form of a solid, monolithic body of material that exhibits a measurable MCE, according to one embodiment. For example, the monolithic body of material may be a foil or sheet made of the desired metal or alloy (e.g., a Gd foil). The insert may be preformed into a particular geometry, or it may be sufficiently thin so as to be manually formable into a desired configuration. It is also contemplated that the magnetocaloric insert may be made of a plurality of pieces of macroscopic or microscopic sizes. For example, the insert may include multiple sheets or take the form of pellets, shot, or powder.

A method of magnetically processing a material that couples high strength magnetic fields with the magnetocaloric effect includes positioning a specimen adjacent to a magnetocaloric insert within a bore of a magnet, and applying a high field strength magnetic field of at least 1 Tesla to the specimen and to the magnetocaloric insert. The specimen may be heated to a desired processing temperature prior to application of the high field strength magnetic field (e.g. in the case of the beryllium-copper alloy discussed previously, the desired processing temperature may be the eutectoid reaction transformation temperature). Advantageously, the magnetocaloric insert has a Curie temperature in the vicinity of the of the desired processing temperature. The temperature of the specimen is changed during the application of the high field strength magnetic field due to the magnetocaloric effect. The temperature of the specimen may decrease (cooling effect), according to one aspect of the method. Alternatively, the temperature of the specimen may increase (heating effect).

As described above, the specimen may be positioned in physical contact with the magnetocaloric insert. The method may further entail positioning a thermally conductive material in physical contact with the specimen and/or in physical contact with the magnetocaloric insert before applying the magnetic field.

The specimen may be made of a ferromagnetic material, such as a steel specimen including retained austenite before the high field strength magnetic field is applied. Alternatively, the specimen may be made of a non-ferromagnetic material, such as the beryllium-copper (Be—Cu) alloy described previously. Other alloys that may benefit from the thermomagnetic processing method described here include Fe-50 wt % Ni, Fe-47 wt % Cr, Ti-20 wt % V, Ti-17 wt % Fe, Ti-29 wt % W, Ti-7 wt % Cu, U-7.6 wt % Nb, and Co-9 wt % Ti, and various Pt—Rh and Au—Ni alloys. The magnetocaloric insert may be as described above and may include a metal selected from the group consisting of Ce, Co, Cu, Dy, Er, Fe, Ga, Gd, Ho, La, Mn, Nd, Ni, Tb, and Tm.

EXAMPLE

Figure 3:
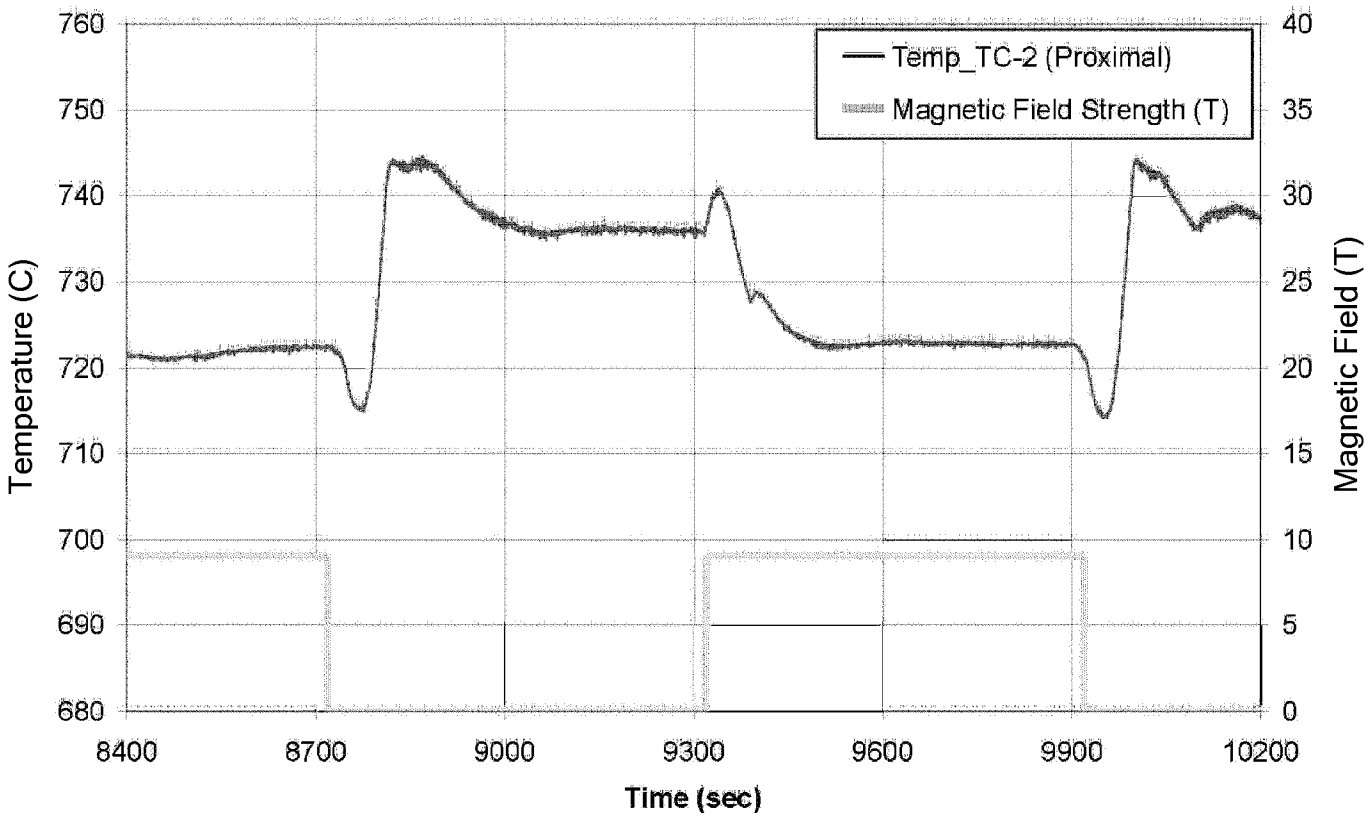
FIG. 3 shows temperature as a function of time with a cyclic magnetic field for an exemplary steel sample to demonstrate the magnetocaloric effect (MCE).

The magnetocaloric effect (MCE) is demonstrated in FIG. 3 which shows temperature as a function of time for a 5160 steel sample in a cyclic magnetic field. The data indicate that the MCE is manifested each time the ferromagnetic sample is inserted and withdrawn from the high magnetic field region at a temperature near its Curie temperature. Exposure to or removal from the magnetic field results in a temperature decrease or increase since the Curie temperature of the steel is nominally 727° C. for this chemistry and the sample is initially held in this temperature regime.

Although the present invention has been described in considerable detail with reference to certain embodiments thereof, other embodiments are possible without departing from the present invention. The spirit and scope of the appended claims should not be limited, therefore, to the description of the preferred embodiments included here. All embodiments that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

The invention claimed is:

1. An apparatus for magnetically processing a specimen:

a high field strength magnet capable of generating a magnetic field of at least 1 Tesla;

a magnetocaloric insert disposed within a bore of the high field strength magnet, the magnetocaloric insert comprising a metal selected from the group consisting of Ce, Co, Cu, Dy, Er, Fe, Ga, Gd, Ho, La, Mn, Nd, Ni, Tb, and Tm.

2. The apparatus of claim 1, wherein the magnetocaloric insert has a hollow shape configured to radially surround a specimen positioned within the bore of the magnet.

3. The apparatus of claim 1, wherein the magnetocaloric insert is configured to be in physical contact with a specimen positioned within the bore of the magnet.

4. The apparatus of claim 1, further comprising a thermally conductive material positioned in contact with the magnetocaloric insert.

5. The apparatus of claim 4, wherein the thermally conductive material is positioned radially inward from the magnetocaloric insert.

6. The apparatus of claim 4, wherein the thermally conductive material is configured to be in physical contact with a specimen positioned within the bore of the magnet.

7. A method of magnetically processing a specimen coupling high strength magnetic fields with the magnetocaloric effect, the method comprising:

positioning a specimen adjacent to a magnetocaloric insert within a bore of a magnet, the magnetocaloric insert comprising a metal selected from the group consisting Ce, Co, Cu, Dy, Er, Fe, Ga, Gd, Ho, La, Mn, Nd, Ni, Tb, and Tm;

applying a high field strength magnetic field of at least 1 Tesla to the specimen and to the magnetocaloric insert;

changing a temperature of the specimen during the application of the high field strength magnetic field, the change of temperature being effected by the magnetocaloric insert.

8. The method of claim 7, wherein the specimen and the magnetocaloric insert are maintained at a desired processing temperature while the high strength magnetic field is applied.

9. The method of claim 8, wherein, prior to applying the high strength magnetic field, the specimen and the magnetocaloric insert are heated to the desired processing temperature.

10. The method of claim 8, wherein the magnetocaloric insert has a Curie temperature near the desired processing temperature.

11. The method of claim 7, wherein changing the temperature of the specimen comprises heating the specimen.

12. The method of claim 7, wherein changing the temperature of the specimen comprises cooling the specimen.

13. The method of claim 7, wherein the specimen is positioned in physical contact with the magnetocaloric insert.

14. The method of claim 7, further comprising positioning a thermally conductive material in physical contact with the specimen and in physical contact with the magnetocaloric insert.

15. The method of claim 7, wherein the specimen comprises a ferromagnetic material.

16. The method of claim 15, wherein the specimen is a steel specimen including retained austenite prior to the application of the high field strength magnetic field.

17. The method of claim 7, wherein the specimen comprises a non-ferromagnetic material.

18. The method of claim 7, wherein the specimen comprises a material selected from the group consisting of Fe-50 wt % Ni, Fe-47 wt % Cr, Ti-20 wt % V, Ti-17 wt % Fe, Ti-29 wt % W, Ti-7 wt % Cu, U-7.6 wt % Nb, and Co-9 wt % Ti, a Pt—Rh alloy, a Au—Ni alloy and a Be—Cu alloy.

* * * * *

UNITED STATES PATENT AND TRADEMARK OFFICE

CERTIFICATE OF CORRECTION

PATENT NO. : 8,522,562 B2
APPLICATION NO. : 13/198180
DATED : September 3, 2013
INVENTOR(S) : Gerard M. Ludtka et al.

It is certified that error appears in the above-identified patent and that said Letters Patent is hereby corrected as shown below:

In the Claims

In column 5, claim 7, line 31, after "from the group consisting" insert --of--.

Signed and Sealed this
Twenty-fourth Day of June, 2014

Michelle K. Lee

Michelle K. Lee
*Deputy Director of the United States Patent and Trademark Office*